US007308227B2

(12) United States Patent
Ahn

(10) Patent No.: US 7,308,227 B2
(45) Date of Patent: Dec. 11, 2007

(54) PAPER ARRANGING APPARATUS AND ELECTROPHOTOGRAPHIC IMAGE FORMING APPARATUS INCLUDING THE SAME

(75) Inventor: Byung-Sun Ahn, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 234 days.

(21) Appl. No.: 11/033,750

(22) Filed: Jan. 13, 2005

(65) Prior Publication Data

US 2005/0191101 A1 Sep. 1, 2005

(30) Foreign Application Priority Data

Feb. 26, 2004 (KR) ..... 10-2004-0012981

(51) Int. Cl.
*G03G 15/00* (2006.01)

(52) U.S. Cl. ..... 399/388; 399/394

(58) Field of Classification Search ..... None
See application file for complete search history.

(56) References Cited

U.S. PATENT DOCUMENTS

| | | | | |
|---|---|---|---|---|
| 4,921,241 | A | 5/1990 | Landa | 271/245 |
| 6,011,948 | A * | 1/2000 | Amano et al. | 399/395 |
| 6,152,443 | A | 11/2000 | Claramunt | 271/258.05 |
| 6,739,778 | B2 * | 5/2004 | Fuchi et al. | 400/693 |
| 6,934,505 | B2 * | 8/2005 | Shin | 399/395 |
| 2003/0113150 | A1 * | 6/2003 | Fujita | 399/394 |
| 2003/0215274 | A1 * | 11/2003 | Ahn | 399/388 |

FOREIGN PATENT DOCUMENTS

| | | |
|---|---|---|
| JP | 04-049148 | 2/1992 |
| JP | 07-041209 | 2/1995 |
| JP | 11-071043 | 3/1999 |
| JP | 2000-072281 | 3/2000 |
| JP | 2000-159360 | 6/2000 |

* cited by examiner

*Primary Examiner*—Anthony H Nguyen
(74) *Attorney, Agent, or Firm*—Roylance, Abrams, Berdo & Goodman, L.L.P.

(57) ABSTRACT

Provided are a paper arranging apparatus and an electrophotographic image forming apparatus. The paper arranging apparatus of an electrographic image forming apparatus has a driving roller and an idle roller facing closely to each other and forming a nip therebetween. A shutter arranges a sheet of paper by contacting a front edge portion of the paper before the front edge portion of the paper enters the nip and rotates after being pushed by the front edge portion of the paper to not interrupt the movement of the paper along the conveyance path. A flag is connected to a rotary shaft of the shutter to rotate in a same direction and at a same rotating angle as the shutter. A sensor senses position variations of the rotating flag and generates a signal representing a position of the paper that is being conveyed. The rotary shaft of the shutter is positioned to return the shutter to an initial position by being rotated in an opposite direction by its own weight after the paper has passed through the nip of the roller. The electrophotographic image forming apparatus having the paper arranging apparatus develops an image on an outer circumferential surface of a photosensitive medium and transfers the image onto a sheet of paper that is conveyed along a predetermined conveying path. The transferred image is fused onto the paper by a thermocompression method.

18 Claims, 7 Drawing Sheets

PAPER ARRANGING APPARATUS AND ELECTROPHOTOGRAPHIC IMAGE FORMING APPARATUS INCLUDING THE SAME

BACKGROUND OF THE INVENTION

This application claims the benefit under 35 U.S.C. § 119(a) of Korean Patent Application No. 2004-12981, filed on Feb. 26, 2004, in the Korean Intellectual Property Office, the entire disclosure of which is hereby incorporated by reference.

FIELD OF THE INVENTION

The present invention relates to a paper arranging apparatus for arranging transferred paper that is to be printed. More particularly, the present invention relates to a electrophotographic image forming apparatus having the paper arranging apparatus.

DESCRIPTION OF THE RELATED ART

In general, an electrophotographic image forming apparatus is an apparatus for printing a desired image. An electrostatic latent image is formed on an outer circumferential surface of a photosensitive medium by a light scanning operation and toner is supplied to the photosensitive medium to develop the electrostatic latent image into an image, which is then transferred and fused onto a sheet of paper.

FIG. 1 is a schematic cross-sectional view of a conventional electrophotographic image forming apparatus. FIGS. 2 and 3 are cross-sectional views of a paper arranging apparatus of the electrophotographic image forming apparatus of FIG. 1. FIG. 2 shows the paper arranging apparatus before the paper enters a nip of a roller. FIG. 3 shows the paper arranging apparatus immediately prior to the paper exiting the nip of the roller.

Referring to FIG. 1, the conventional electrophotographic image forming apparatus 10 includes a first cassette 12 and a second cassette 15 in which paper 1 (or any other printing medium) is disposed. The first and second cassettes 12 and 15 are preferably detachably installed in a case 11. Pick-up rollers 13 and 16 are installed respectively proximal the first and second cassettes 12 and 15 to pick up the paper one sheet at a time. A developing apparatus 40 to develop an image and a transfer roller 55 to transfer the image developed by the developing apparatus 40 onto the paper 1 are installed on a conveying path of the paper 1 conveyed by the pickup rollers 13 and 16.

The developing apparatus 40 is preferably a cartridge type that is detachably installed in the case 11, and includes a housing 41 and a photosensitive medium 50 having an outer circumferential surface on which an electrostatic latent image is formed by a light scanning unit 60. The photosensitive medium 50 faces the transfer roller 55 in the area in which paper 1 is transferred therebetween. Also, the developing apparatus 40 includes a developer container 42 that stores a toner, that is, the developer, an agitator 43 installed on a lower portion of the developer container 42 to shake the developer container 42 so that the developer is not congealed, a developing roller 45 that is rotated while contacting the photosensitive medium 50 and supplies the developer onto the electrostatic latent image formed on the outer circumferential surface of the photosensitive medium 50 to develop a predetermined image, and a supplying roller 44 that rotates while contacting the developing roller 45 and supplies the developer filled in the developer container 42 to the developing roller 45. Also, the developing apparatus 40 includes a controlling blade 46 that controls a thickness of the developer that is attached onto the surface of the developing roller 45 by the supplying roller 44, and a cleaning blade 48 that removes the remaining toner that is not transferred onto the paper 1 from the photosensitive medium 50. The toner removed by the cleaning blade 48 is stored in a used toner storage unit 49, and recovered by a recovery device (not shown).

The transfer roller 55 is installed to contact the photosensitive medium 50, and presses the paper 1 toward the photosensitive medium 50 so that the image formed on the photosensitive medium 50 may be transferred onto the paper 1.

The toner image transferred onto the paper 1 by the transfer roller 55 is fused onto the paper 1 by heat and pressure while passing through a fusing device 65 that is installed on the paper conveying path. The paper is discharged out of the case 11 by discharging rollers 67 and stacked on a paper discharging board 70.

The paper 1 from the first or second cassettes 12 or 15 passes through a paper arranging apparatus 20 before reaching to the photosensitive medium 50, and is arranged for proper registration so that the image may be transferred onto a desired position of the paper 1.

Referring to FIGS. 2 and 3, the paper arranging apparatus 20 includes a driving roller 21 and an idle roller 25 that form a nip (N) and face each other, a shutter 30 and a flag 33 coaxially connected to a rotary shaft 26 of the idle roller 25 so as to be rotatable, and a sensor 28 that senses a position of the paper 1 by rotation of the flag 33. As the paper 1 moves along the paper conveying path, a front edge portion 1*a* of the paper contacts a paper facing surface 31 of the shutter 30 prior to reaching the nip N between the rollers 21 and 25. The paper facing surface is at a lower end portion of the shutter 30. As the front edge portion 1*a* of the paper 1 continues to move forward, the paper pushes the paper facing surface 31 of the shutter 30, which rotates the shutter 30 in a clockwise direction as the front edge portion 1*a* of the paper 1 enters the nip N between the rollers 21 and 25. At the same time, a part of the front edge portion 1*a* that protrudes forward in the proceeding direction of the paper is pushed backward by a reaction force of the shutter 30, and thus the paper 1 is arranged for proper registration.

When the shutter 30 rotates, the flag 33 is rotated with the shutter, thereby removing the flag from the sensor 28. The sensor 28 senses that the front edge portion 1*a* of the paper 1 has reached the paper arranging apparatus 20 and transmits the sensing signal to a controller (not shown) of the image forming apparatus 10. Then, the controller transmits a control signal to initiate the light scanning unit 60 and to rotate the photosensitive medium 50 after a predetermined time has elapsed for the paper 1 to reach the photosensitive medium 50. In addition, when a rear edge portion 1*b* of the paper 1 exits from the nip N, the shutter 30 and the flag 33 rotate in a counter-clockwise direction to return to the position shown in FIG. 2, and the sensor 28 senses that the paper 1 has passed the paper arranging apparatus 20 and transmits the appropriate sensing signal to the controller.

However, in the conventional paper arranging apparatus, since the shutter 30 rotates with the rotary shaft 26 of the idle roller 25, rotating angles of the shutter 30 and the flag 33 are large because of the passing of the paper 1. That is, the sensor 28 cannot immediately sense the entering point of the front edge portion 1*a* into the nip N and the exiting point of the rear edge portion 1*b* out of the nip N, thereby reducing a reliability of the paper arranging operation, that is, registration.

Also, since the shutter 30 rotates in the clockwise direction by being pushed by the paper 1, the front edge portion 1*a* may follow the rotating shutter 30 due to a friction between the paper facing surface 31 and the front edge portion 1*a*, thus the paper 1 may be crumpled.

In addition, as shown in FIG. 3, as the paper 1 passes through the paper arranging apparatus 20, the shutter 30 may press the printing surface of the paper due to its own weight, and thus an electrostatic force may be generated by friction, and problems with the printing quality, such as image dragging and a difference in printing densities, may result.

One suggested solution to these problems is a method that arranges the paper before the paper enters the nip by connecting a clutch (not shown) on the rotary shaft of the paper feeding roller, and rotating the paper feeding roller to move the paper instead of using the shutter 30. However, manufacturing costs of the image forming apparatus rise due to the addition of a clutch, and the paper arranging efficiency is not greatly improved.

SUMMARY OF THE INVENTION

The present invention is a paper arranging apparatus that substantially immediately senses the entrance and exit of paper into and out of a nip of a roller, and an electrostatic image forming apparatus including the paper arranging apparatus.

According to an aspect of the present invention, a paper arranging apparatus includes a driving roller and an idle roller facing closely to each other and forming a nip therebetween. A shutter arranges a sheet of paper by contacting a front edge portion of the paper before the front edge portion of the paper enters the nip, and rotates after being pushed by the front edge portion of the paper so as not to interrupt the movement of the paper. A flag is connected to a rotary shaft of the shutter to rotate in a same direction and at a same rotating angle as the shutter. A sensor senses position variations of the rotating flag and generates a signal representing a position of the paper that is being conveyed. The rotary shaft of the shutter is positioned to return the shutter to an initial position by being rotated in the opposite direction by its own weight after the paper has passed through the nip of the roller.

The rotary shaft of the shutter may be located at a lower space between two spaces that are divided by a virtual plane including a rotary shaft of the driving roller and a rotary shaft of the idle roller.

The rotary shaft of the shutter may be located at a lower position than the roller nip.

A distance from the rotary shaft of the shutter to the roller nip may be longer than a radius of the roller that is relatively closer to the rotary shaft of the shutter.

A surface of the shutter, which is contacted by the front edge portion of the paper, may include a slanted surface so that the front edge portion of the paper mat be guided to the roller nip.

The paper arranging apparatus may further include a spring providing the shutter and the flag with a restoration force to rotate the shutter and the flag in the opposite direction to return to the initial position after the paper has passed the roller nip.

The paper arranging apparatus may further include a stopper controlling the rotating angle of the shutter.

In a state where the paper does not enter the roller nip, a centroid of the flag may be located in a space where the centroid of the shutter is located between two spaces divided by a virtual vertical plane including the rotary shaft of the shutter.

According to another aspect of the present invention, an electrophotograhpic image forming apparatus develops an image on an outer circumferential surface of a photosensitive medium, transfers the image onto a sheet of paper conveyed along a predetermined conveying path, and fuses the transferred image onto the paper by a thermocompression method. A paper arranging apparatus is located in front of the photosensitive medium on the conveying path of the paper, and arranges the paper to transfer the image onto a desired position of the paper. The paper arranging apparatus includes a driving roller and an idle roller facing closely to each other and forming a nip therebetween. A shutter arranges a sheet of paper moving along a C-shaped conveying path to an upper portion by contacting a front edge portion of the paper before the front edge portion of the paper enters the nip. The shutter rotates after being pushed by the front edge portion of the paper to avoid interrupting the movement of the paper. A flag is connected to a rotary shaft of the shutter to rotate in a same direction and at a same rotating angle as the shutter. A sensor senses position changes of the rotating flag and generates a signal representing a position of the paper that is being conveyed. The rotary shaft of the shutter is positioned so that the shutter returns to an initial position by being rotated in an opposite direction by a weight of the shutter after the paper has passed through the nip of the roller.

The rotary shaft of the shutter may be located in a lower space between two spaces that are divided by a virtual plane including a rotary shaft of the driving roller and a rotary shaft of the idle roller.

The rotary shaft of the shutter may be located at a lower position than the roller nip.

A distance from the rotary shaft of the shutter to the roller nip may be longer than a radius of the roller that is relatively closer to the rotary shaft of the shutter.

A surface of the shutter, which is contacted by the front edge portion of the paper, may include a slanted surface so that the front edge portion of the paper may be guided to the roller nip.

The paper arranging apparatus may further include a spring providing the shutter and the flag with a force of restoration so that the shutter and the flag rotate in opposite directions to return to the initial position after the paper has passed the roller nip.

The paper arranging apparatus may further include a stopper controlling the rotating angle of the shutter.

In a state where the paper does not enter the roller nip, a centroid of the flag may be located in a space where the centroid of the shutter is located between two spaces divided by a virtual vertical plane including the rotary shaft of the shutter.

BRIEF DESCRIPTION OF THE DRAWINGS

The above and other features and advantages of the present invention will become more apparent by describing in detail exemplary embodiments thereof with reference to the attached drawings in which:

FIG. 2 shows a position before a sheet of paper enters a nip between rollers, and FIG. 3 shows a position immediately before the paper exits the nip of the rollers;

FIG. 6 shows a position immediately before a front edge portion of the paper enters a nip, FIG. 7 shows a position in which a front edge portion of the paper is in the nip, and FIG. 8 shows a position in which a rear edge portion of the paper is exiting the nip; FIG. 9 shows a position immediately before a front edge portion of the paper enters the nip, and FIG. 10 shows a position in which a rear edge portion of the paper is exiting the nip.

Throughout the drawings, like reference numerals will be understood to refer to like parts, components and structures.

DETAILED DESCRIPTION OF THE EXEMPLARY EMBODIMENTS

Hereinafter, a paper arranging apparatus and an electrophotographic image forming apparatus including the paper arranging apparatus according to exemplary embodiments of the present invention will be described with respect to accompanying drawings.

Figure 1:
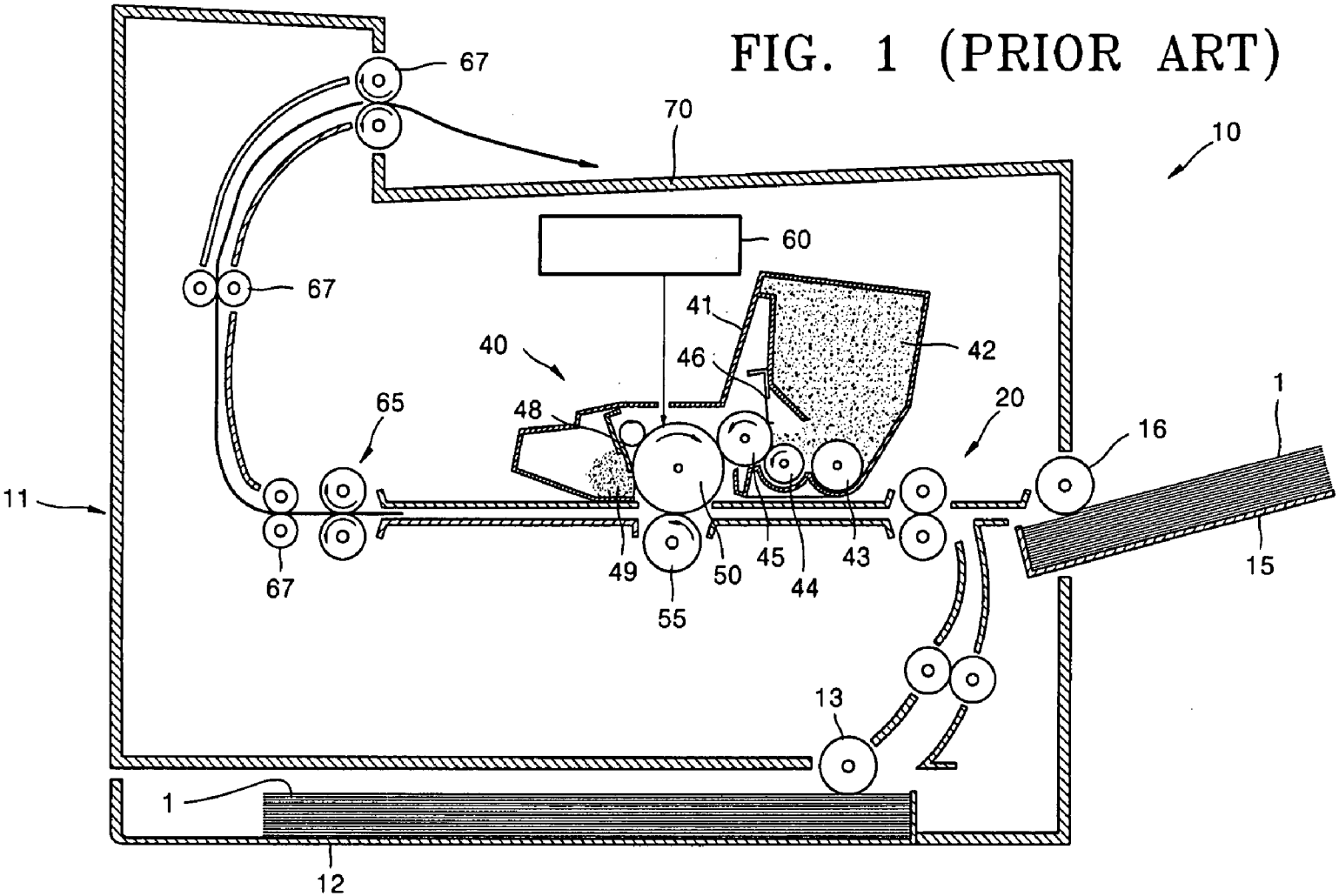
FIG. 1 (PRIOR ART)
FIG. 1 is a schematic cross-sectional view of a conventional electrostatic image forming apparatus.
Figure 2:
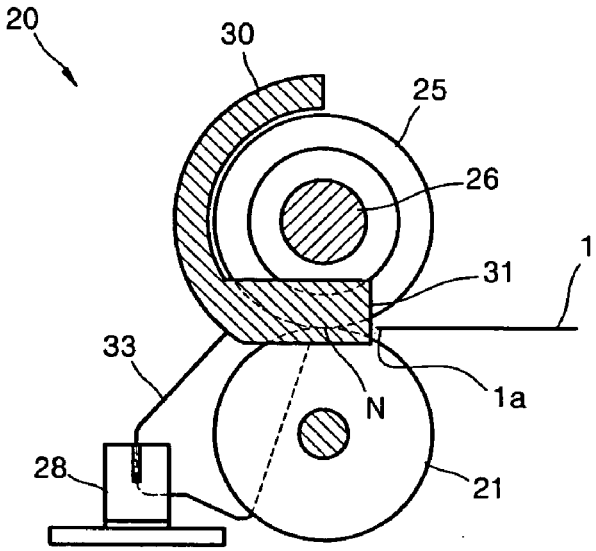
FIG. 2 (PRIOR ART)
FIGS. 2 and 3 are cross-sectional views of a paper arranging apparatus of the conventional electrostatic image forming apparatus, where
Figure 3:
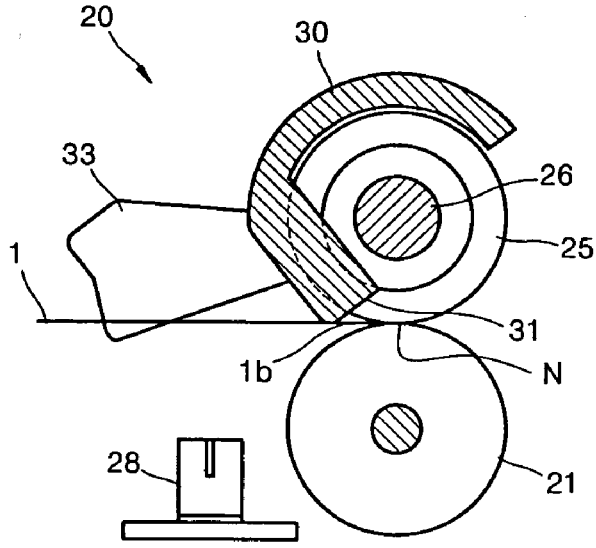
FIG. 3 (PRIOR ART)
Figure 4:
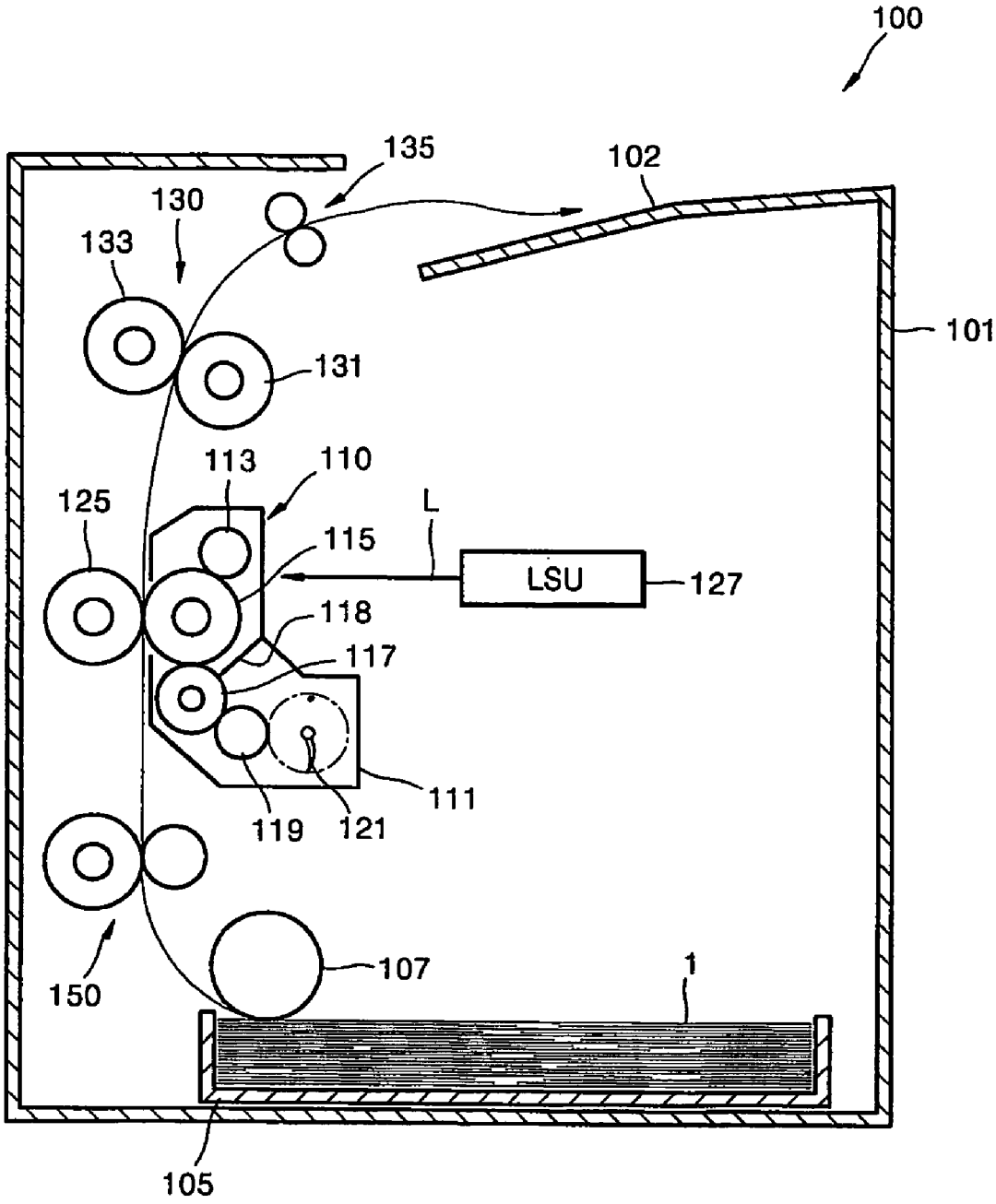
FIG. 4 is a schematic cross-sectional view of an electrostatic image forming apparatus according to an exemplary embodiment of the present invention.
Figure 5:
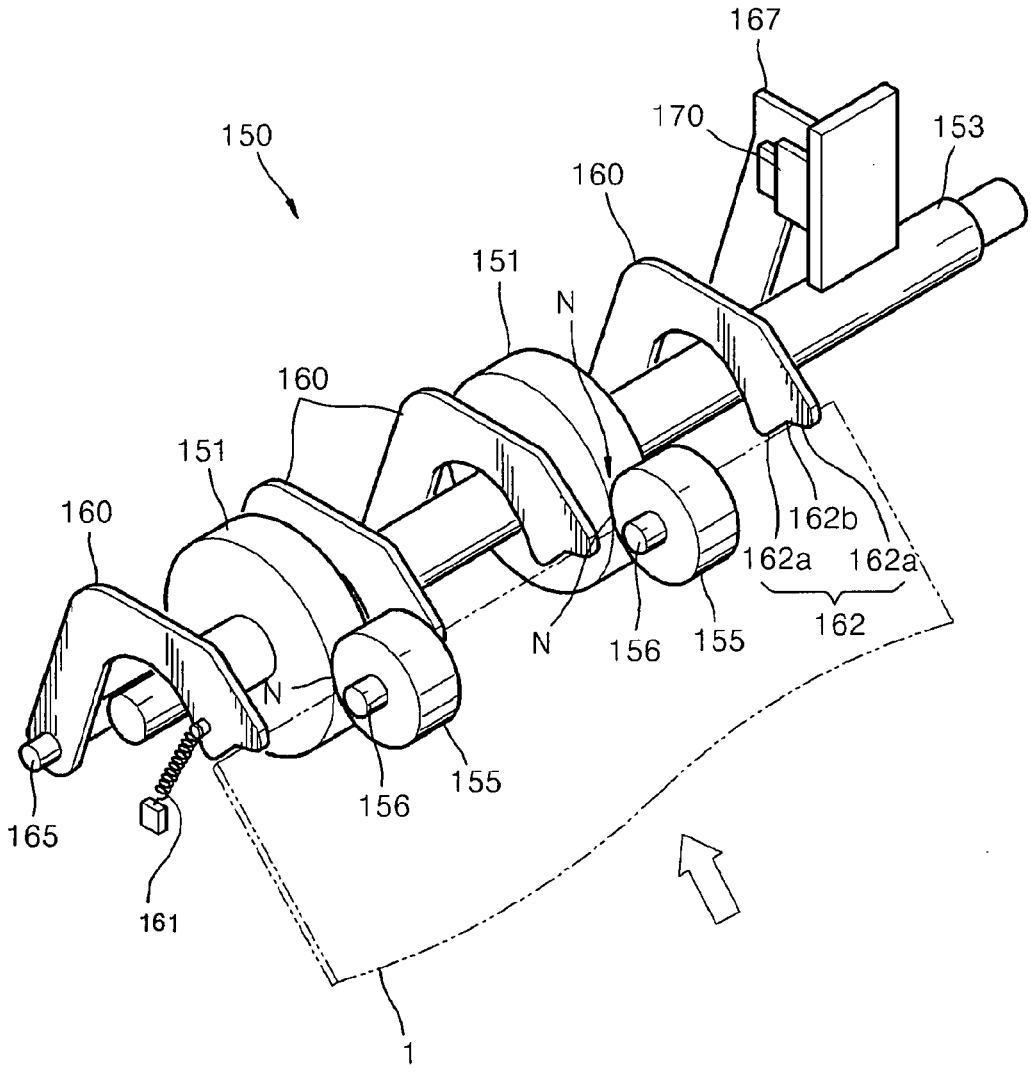
FIG. 5 is a perspective view of a paper arranging apparatus of the electrostatic image forming apparatus of FIG. 4 according to a first embodiment of the present invention.
Figure 6:
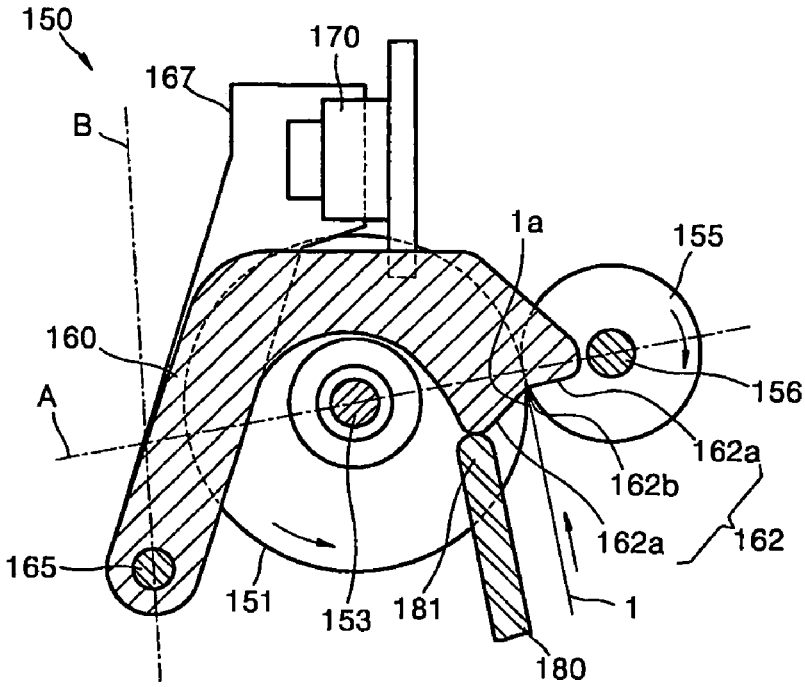
FIGS. 6-8 are cross-sectional views of the paper arranging apparatus of FIG. 5, where
Figure 7:
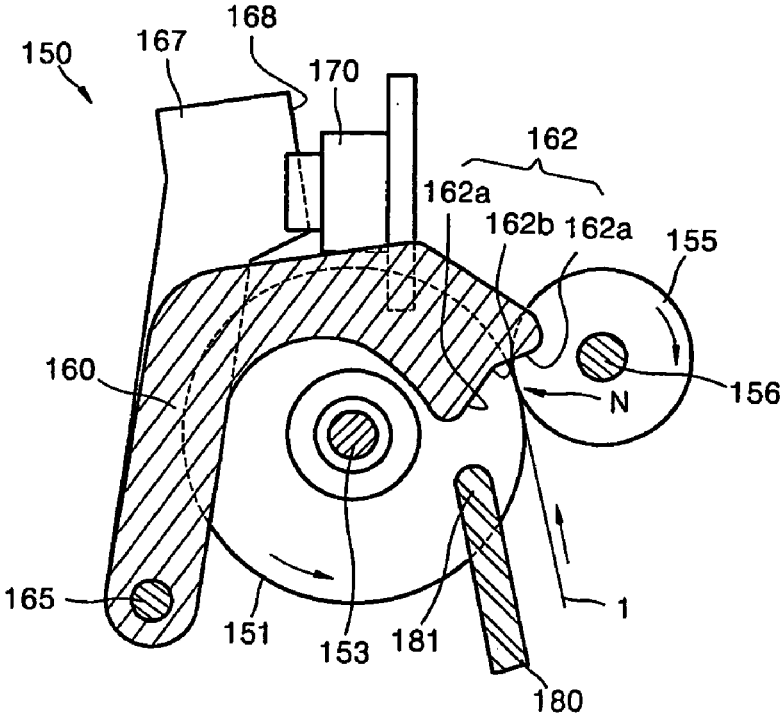
Figure 8:
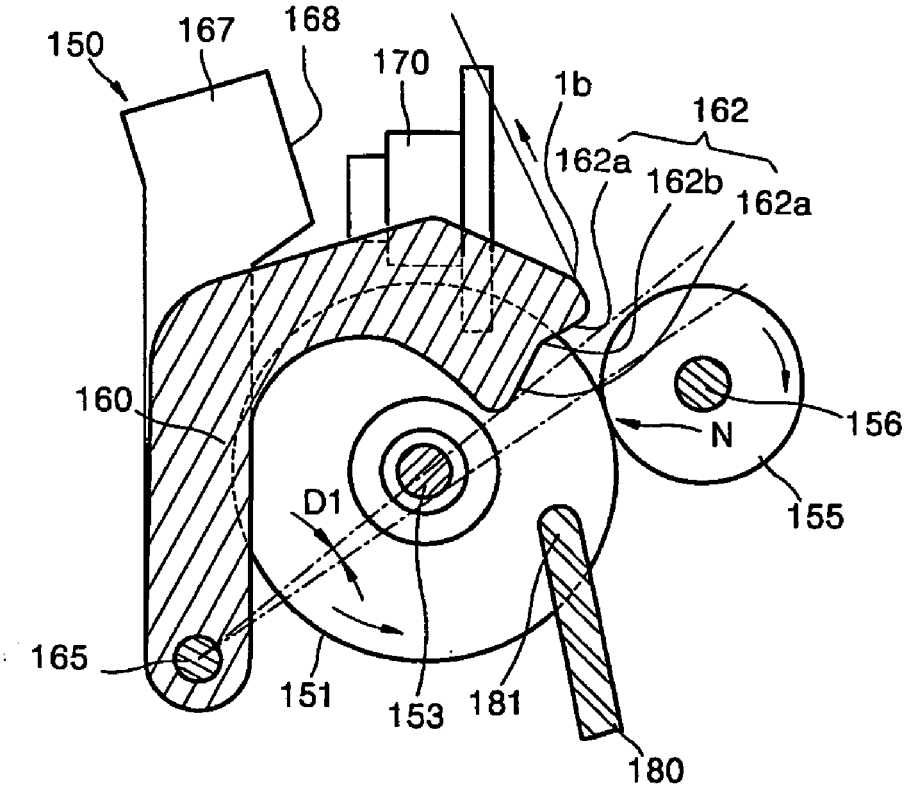

FIG. 4 is a schematic cross-sectional view of an electrophotographic image forming apparatus according to an embodiment of the present invention, and FIG. 5 is a perspective view showing a paper arranging apparatus included in the apparatus of FIG. 4 according to a first embodiment of the present invention. In addition, FIGS. 6 through 8 are cross-sectional views of the paper arranging apparatus shown in FIG. 5. FIG. 6 shows a position immediately before a front edge portion of the paper enters the nip. FIG. 7 shows a position in which the front edge portion enters the nip. FIG. 8 shows a position in which a rear edge portion of the paper is exiting the nip.

Referring to FIG. 4, an electrophotographic image forming apparatus 100 according to the exemplary embodiment of the present invention is a C-path type image forming apparatus. Paper 1 proceeds along a conveying path that is substantially C-shaped from a lower portion to an upper portion, where the paper is discharged out of the apparatus. The electrophotograhpic image forming apparatus 100 includes a case 101, a developing apparatus 110 that is detachably installed in the case 101, a fusing device 130, and a transfer roller 125. Further, the apparatus 100 includes a paper cassette 105, in which the paper 1 is disposed, and a light scanning unit (LSU) 127.

The developing apparatus 110 includes a housing 111 containing a toner, that is, a developer, a photosensitive medium 115 for forming an electrostatic latent image by the light scanning operation, a charging roller 113 for charging the photosensitive medium 115, a developing roller 117 for forming an image on an outer circumferential surface of the photosensitive medium 115 by supplying the developer onto the electrostatic latent image formed on the outer circumferential surface of the photosensitive medium 115, a controlling blade 118 that controls a thickness of the developer that is attached onto the surface of the developing roller 117, and a supplying roller 119 for supplying the developer to the developing roller 117. In addition, an agitator 121 is disposed in the housing 111 to shake the supplying roller 119 so that the developer is not congealed. The developing apparatus 110 is formed as a cartridge, thus when the developer in the apparatus is exhausted, the developing apparatus 110 may be replaced.

The transfer roller 125 faces the photosensitive medium 115 and contacts a portion thereof, and presses the paper 1 toward the photosensitive medium 115 to transfer the image formed on the outer circumferential surface of the photosensitive medium 115 onto the paper 1 that passes between the transfer roller 125 and the photosensitive medium 115.

The fusing device 130 includes a heating roller 131 and a pressing roller 133 facing the heating roller 131. When the paper 1, on which the image is transferred, passes between the heating roller 131 and the pressing roller 133, the image is fused on the paper 1 by a thermocompressing operation using heat and pressure.

The electrophotographic image forming apparatus 100 includes a pickup roller 107 that picks up the paper 1 disposed in the cassette 105 that is disposed on the lower portion of the case 101 one by one. A paper arranging apparatus 150 provides a conveying force to the paper 1, and arranges the paper 1 before the paper 1 reaches to the photosensitive medium 115 to transfer the image onto a desired position on the paper 1. Further, the apparatus 100 includes a paper discharging roller 135 for discharging the paper 1 on which a predetermined image is printed to a paper discharging board 102.

Operations of the electrophotographic image forming apparatus 100 having the above structure will be described as follows. The photosensitive medium 115 is charged to a predetermined potential by the charging roller 113, and an electrostatic latent image corresponding to the image that is to be printed is formed on the outer circumferential surface of the photosensitive medium 115 in response to a laser (L) scanned from the LSU 127. The developer in the housing 111 of the developing apparatus is supplied to the photosensitive medium 115, on which the electrostatic latent image is formed, through the supplying roller 119 and the developing roller 117, and the image is developed on the outer circumferential surface of the photosensitive medium 115. The paper 1 on the top of the paper cassette 105 is picked up by the pickup roller 107, and arranged and supplied by the paper arranging apparatus 150 to pass between the photosensitive medium 115 and the transfer roller 125. Here, the image developed on the outer circumferential surface of the photosensitive medium 115 is transferred onto the surface of the paper 1 that faces the photosensitive medium 115. The image transferred on the paper 1 is fused onto the paper 1 by heat and pressure when the paper 1 passes through the fusing device 130. The paper 1 is then conveyed by the paper discharging roller 135 and discharged to the paper discharging board 102.

Referring to FIGS. 5 to 8, the paper arranging apparatus 150 according to a first embodiment of the present invention includes a driving roller 151 and an idle roller 155 disposed closely to each other, a shutter 160 that rotates with an additional rotary shaft 165 and not to rotary shafts 153 and 156 of the rollers 151 and 155, a flag 167 coaxially connected to the rotary shaft 165 of the shutter 160, and a sensor 170 that senses the position changes of the flag 167 to generate a signal for notifying the position of the conveying paper 1.

Outer circumferential surfaces of the driving roller 151 and the idle roller 155 face and push each other, and the pressed portion forms a roller nip N therebetween. The rotary shaft 153 of the driving roller 151 is connected to a driving unit, such as a motor (not shown), and the idle roller 155 is rotated with the rotation of the driving roller 151. When a front edge portion 1*a* of the paper 1 enters the nip N, the paper 1 is engaged by the two rotating rollers 151 and 155 and proceeds upwardly.

A plurality of shutters 160 have cross sectional shapes of an arch or a horseshoe to substantially prevent contact with the rotary shaft 153 of the driving roller 151. End portions of the shutters 160 are connected to a shutter rotary shaft 165 and rotate together. As shown in FIG. 5, the shutters 160 are disposed on either side of the driving rollers 151, which are separated from each other, to substantially prevent contact with the driving rollers 151. Each shutter 160 includes a paper facing surface 162 that faces the front edge portion 1*a* of the paper so that the front edge portion 1*a* of the paper 1 that proceeds upwardly contacts the paper facing surface 162 before the paper 1 enters the nip N. The paper facing surface 162 has a concavely slanted surface 162*a* so as to form a valley 162*b* on a center portion of the paper facing surface 162. Referring to FIG. 6, in a position where the paper 1 does not enter the roller nip N, the valley 162*b* is located in the same position as the initial point of the nip N or a lower position that is 5 mm or less apart from the initial point of the nip N. Thus, the paper 1 that proceeds upwardly contacts the slanted surface 162*a* or the valley 162*b* of the paper facing surface 162 before the front edge portion 1*a* thereof enters the roller nip N, and the front edge portion 1*a* that initially contacts the slanted surface 162*a* is slid to the valley 162*b* and can enter the roller nip N smoothly.

The shutter rotary shaft 165 is located in a lower space between two spaces that are divided by a virtual plane including the driving roller rotary shaft 153 and the idle roller rotary shaft 156. In addition, the rotary shaft 165 is located in a lower position than the roller nip N. In FIG. 6, the virtual plane is denoted as the dashed dot line A that connects the driving roller rotary shaft 153 with the idle roller rotary shaft 156. Also, a distance between the shutter rotary shaft 165 and the roller nip N is longer than a radius of the driving roller 151 that is relatively closer to the shutter rotary shaft 165 than the idle roller 155.

Each of the shutters 160 includes a stopper for controlling the rotating angle of the shutter 160. In the embodiments shown in FIGS. 6-8, an upper end portion 181 of a guide 180 that guides the conveying path of the paper 1 performs as the stopper. A corner of the shutter 160 is supported by the upper end portion 181 of the stopper 180 before the paper 1 reaches the roller nip N. When the paper 1 passes through the roller nip N, the shutter 160 is rotated in a counter-clockwise direction due to a force pushed from the front edge portion 1*a* of the paper 1 and is moved away from the path of the paper 1. When the rear edge portion 1*b* of the paper 1 exits the roller nip N, the shutter 160 is rotated in a clockwise direction by its own weight until the paper facing surface 162 reaches the stopper 181, and waits for the next paper 1. According to a modified embodiment of the paper arranging apparatus 150, an additional stopper may be further disposed to control the rotating angle of the shutter 160 in the counter-clockwise direction, however, the additional stopper is not shown in drawings.

The flag 167 is positioned out of the conveyance path of the paper 1 so as to not interrupt the movement of the paper 1, as shown in FIG. 5. Also, as shown in FIG. 6, the flag 167 extends from the shutter rotary shaft 165 toward the upper right direction where a centroid of the shutter 160 is located. Accordingly, in a position where the paper 1 has not yet entered the roller nip N, the centroid of the flag 167 is located in one space in which the centroid of the shutter 160 is located, which is between two spaces divided by a virtual vertical plane including the shutter rotary shaft 165. In FIG. 6, the virtual vertical plane is denoted by the dashed dot line B. Accordingly, when the shutter 160 rotates in the clockwise direction from the position of being moved aside from the conveyance path of the paper 1 as shown in FIG. 8 to the position of FIG. 6, a torque caused by the weight of the flag 167 is added to a torque caused by the weight of the shutter 160, thereby returning the shutter 160 faster.

The sensor 170 is an optical sensor that projects the light onto the front edge portion of the flag 168 and senses the position variations of the flag 167 and shutter 160 from the light reflection. The sensor 170 is fixedly installed to overlap with the flag front edge portion 168 in a position where the paper 1 does not enter the roller nip N, as shown in FIGS. 5 and 6, and is connected to a controller (not shown) of the image forming apparatus 100 to exchange electric signals with the controller. The flag 167 and the optical sensor 170 are installed so that the flag front edge portion 168 moves out of the optical sensor 170 at the same time when the front edge portion 1*a* of the paper 1 enters into the roller nip N.

When the flag front edge portion 168 exits the optical sensor 170, the optical sensor 170 generates a signal related to the position of the paper 1, which is reaching the front edge portion 1*a* of the roller nip N, and transmits the signal to the controller. The controller commands respective elements to start the printing operation, such as the light scanning of the LSU 127 and rotation of the photosensitive medium 115, after a predetermined time has elapsed for the paper 1 to reach to the photosensitive medium 115 based on the signal of the sensor 170. When the paper 1 passes through the roller nip N, the flag 167 stays in that position where the front edge portion 168 does not overlap with the optical sensor 170, as shown in FIG. 8. Thus, it is signalled that the paper 1 is passing through the roller nip N. When the rear edge portion 1*b* of the paper 1 exits the roller nip N, the flag 167 is rotated in the clockwise direction, and the sensor 170 generates a signal indicating that the paper 1 exits the roller nip N once the flag-front edge portion 168 starts to overlap the optical sensor 170, as shown in FIG. 7. The signal is transmitted to the controller. The controller 170 commands the elements to stop the printing operation after a predetermined time has elapsed for the paper 1 to reach the photosensitive medium 115 based on the signal of the sensor 170.

According to a modified embodiment of the paper arranging apparatus 150, an additional spring 161, as shown in FIG. 5, may be included to more quickly return the shutter 160 and the flag 167 to the initial status shown in FIG. 6 after the rear edge portion 1*b* of the paper 1 exits the roller nip N. The spring 161 may be a coil spring having an end coupled to the flag 167 or the shutter 160, as shown in FIG. 5, or it may be a torsion spring coupled to the shutter rotary shaft 165.

In the paper arranging apparatus 150 having the above structure, the front edge portion 1*a* of the paper 1 proceeds upwardly as shown in FIG. 6 and contacts the paper facing surface 162 of the shutter 160. A portion that protrudes more to the upper direction on the front edge portion 1*a* of the paper is pushed backward while forming a loop by the reaction force of the shutter 160, thereby arranging the paper 1. In addition, the front edge portion 1*a* of the paper 1 proceeds while pushing the paper facing surface 162 and enters the roller nip N, and is then conveyed by the rollers 151 and 155. The shutter 160 rotates in the counter-clockwise direction to move out of the conveyance direction of the paper 1.

When the paper 1 is passing through the roller nip N, a corner of the paper facing surface 162 of the shutter 160 contacts the paper 1, as shown in FIG. 8. However, since the paper 1 proceeds in a nearly vertical direction, the pressure exerted by the shutter 160 is not much larger than that of the conventional art. Therefore, the printing problems such as image dragging or different printing density due to the friction on the surface of the paper 1 may be reduced.

Also, the rotating angle of the shutter 160 when the paper 1 passes through the roller nip N in the paper arranging apparatus 150 is smaller than that of the conventional art due to the position of the shutter rotary shaft 165. Accordingly, the rotating angle of the flag 167 is also reduced. The rotating angle D1 of the flag 167 until the flag 167 is sensed by the sensor 170 after the rear edge portion 1*b* of the paper 1 passes through the roller nip N is also reduced, as shown in FIG. 8. Therefore, generation rate of the sensing error of the sensor 170 for the proceeding position of the paper 1 is reduced less than that of the conventional art.

In the paper arranging apparatus 150, a distance from the shutter rotary shaft 165 to the roller nip N is longer than that of the conventional art, and the rotating radius of the paper facing surface 162 of the shutter 160 becomes larger than that of the conventional art. Accordingly, even if the front edge portion 1*a* of the paper is bent toward the rotating direction of the paper facing surface 162 due to the friction, a curvature of the front edge portion 1*a* of the paper 1 is smaller than that of the conventional art. Therefore, the front edge portion 1*a* may not be crumpled or otherwise damaged. Also, the paper facing surface 162 of the shutter 160 is rotated in the counter-clockwise direction in the conveyance direction of the paper, and thus the probability of crumpling the paper is further reduced.

Figure 9:
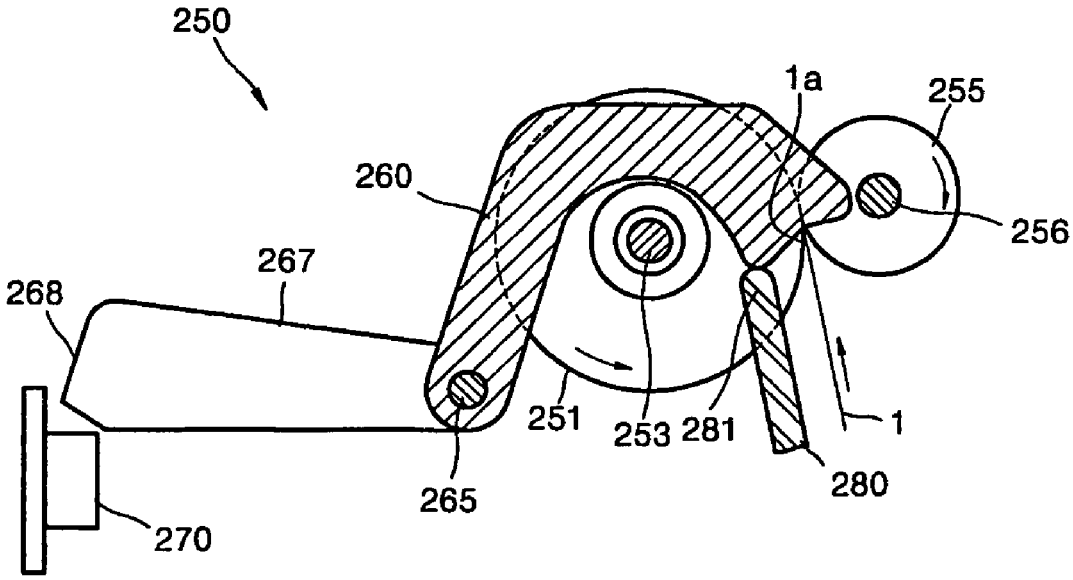
FIGS. 9 and 10 are cross-sectional views showing a paper arranging apparatus according to a second embodiment of the present invention, where
Figure 10:
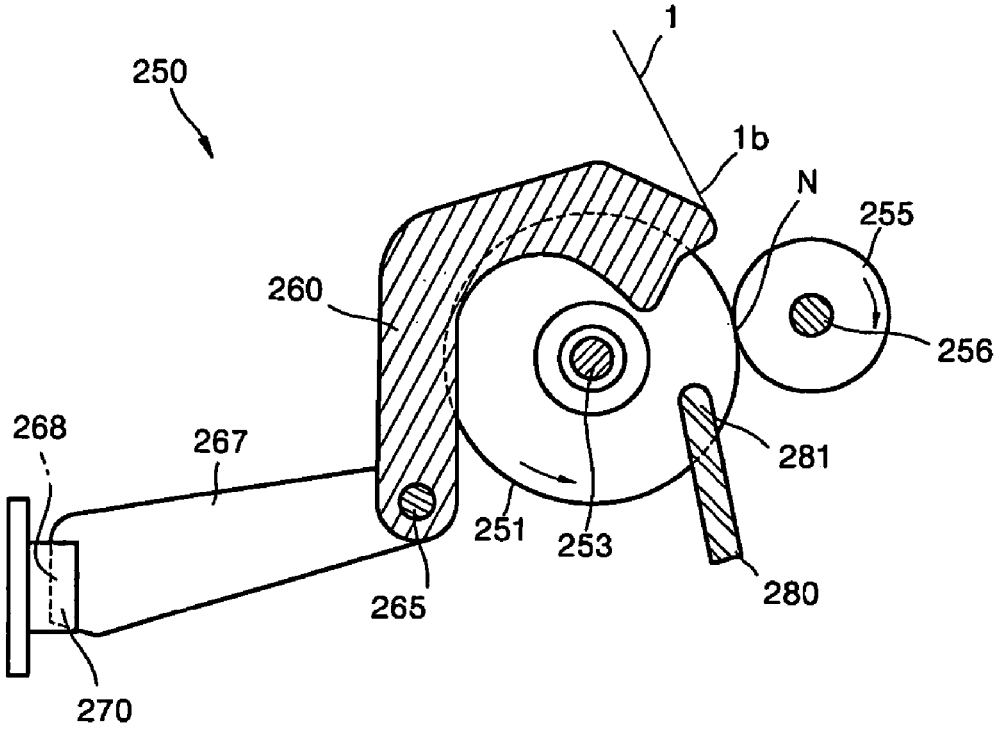

FIGS. 9 and 10 are cross-sectional views of a paper arranging apparatus according to a second embodiment of the present invention. FIG. 9 is a view showing a position immediately before a front edge portion of the paper enters the nip. FIG. 10 is a view of a position in which a rear edge portion of the paper exits the nip. The paper arranging apparatus 250 according to the second embodiment of the present invention may be adopted in the electrophotographic image forming apparatus 100 instead of the paper arranging apparatus 150 according to the first embodiment.

Referring to FIGS. 9 and 10, the paper arranging apparatus includes a driving roller 251 and an idle roller 255 that are disposed closely to each other. A shutter 260 rotates with an additional rotary shaft 165 to which it is connected, rather than with rotary shafts 253 and 256 of the above rollers 251 and 255. A flag 267 is connected to the rotary shaft 265 of the shutter 260. A sensor 270 senses position variations of the flag 267 and generates a signal representing the position of the paper 1. A stopper 281 is disposed on an upper end portion of a guide 280 to control the rotating angle of the shutter 260. The rollers 251 and 255, the shutter 260, and the stopper 281 are the same as those of the paper arranging apparatus 150 according to the first embodiment of the present invention, and detailed descriptions for those are omitted.

The flag 267 extends from the shutter rotary shaft 265 in a direction opposite to that of the shutter extending direction. The sensor 270 is an optical sensor that projects a light to sense the position variation due to the rotations of the flag 267 and the shutter 260 by detecting the reflection of the light, and exchanges electric signals with a controller (not shown) of the image forming apparatus 100. However, the optical sensor 270 of the present embodiment is different from that of the first embodiment. As shown in FIG. 9, in a state where the paper 1 has not yet entered the roller nip N, a front edge portion 268 of the flag 267 does not overlap the optical sensor 270. As shown in FIG. 10, when the paper 1 is passing through the roller nip N, the front edge portion 268 of the flag 267 overlaps the optical sensor 270. Accordingly, the optical sensor 270 generates a signal notifying the paper position, that is, that the front edge portion 1*a* of the paper 1 has reached the roller nip N when the flag front edge portion 268 rotates in the counter-clockwise direction and overlaps with the optical sensor 270, and transmits the signal to the controller. In addition, when the flag front edge portion 268 rotates in the clockwise direction and moves away from an overlapping position with the optical sensor 270, the sensor 270 generates a signal notifying that the paper 1 has passed from the roller nip N and transmits the signal to the controller.

According to another modified embodiment of the paper arranging apparatus 250, an additional spring may be disposed so that the shutter 260 and the flag 270 may more quickly return to the initial states shown in FIG. 9 after the rear edge portion 1*b* of the paper 1 has passed the roller nip N. However, the above modification is not shown in drawings. The spring may be a coil spring having one end coupled to the flag 267 or the shutter 260, or the spring may be a torsion spring that is coupled to the shutter rotary shaft 265.

According to the paper arranging apparatus and the electrophotographic image forming apparatus of an embodiment of the present invention, the rotating angles of the shutter and the flag are reduced when the paper is passing through the roller nip, as well as reducing the sensing error of the sensor for the paper position. Accordingly, the reliability of printing, that is, printing of the image in the desired position, may be improved.

In addition, since the rotating radius of the paper-facing surface of the shutter is large and a curvature of the front edge portion of the paper that contacts the paper facing surface is reduced, the crumple or damage of the paper is substantially eliminated. Also, according to the exemplary embodiments of the present invention, when the paper enters the roller nip, the rotating direction of the paper facing surface corresponds to the proceeding direction of the paper, thereby reducing the crumpling of the front edge portion of the paper.

According to the exemplary embodiments of the present invention, when the paper is passing through the roller nip, the pressure of the shutter onto the paper is not larger than the conventional art, thus the printing defects, such as the image dragging and the difference of densities caused by the friction on the surface of the paper, are reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper arranging apparatus, comprising:

a driving roller and an idle roller forming a nip therebetween;

a shutter connected to a rotary shaft to arrange a sheet of paper by contacting a front edge portion of the paper before the front edge portion of the paper enters the nip, and to rotate after being pushed by the front edge portion of the paper to not interrupt the movement of the paper;

a flag connected to the rotary shaft of the shutter to rotate in a same direction and at a same rotating angle as the shutter; and a sensor sensing position variations of the rotating flag and generating a signal representing a position of the paper being conveyed, wherein the rotary shaft of the shutter is positioned to return the shutter to an initial position by rotating in the opposite direction due to the weight of the shutter after the paper has passed through the nip of the roller, an axis of rotation of the shutter rotary shaft being spaced from axes of rotation of the driving and idle rollers.

2. The apparatus of claim 1, wherein the rotary shaft of the shutter is located in a lower space between two spaces that are divided by a virtual plane including a rotary shaft of the driving roller and a rotary shaft of the idle roller.

3. The apparatus of claim 1, wherein the rotary shaft of the shutter is located below the roller nip.

4. The apparatus of claim 1, wherein a distance from the rotary shaft of the shutter to the roller nip is longer than a radius of the roller that is relatively closer to the rotary shaft of the shutter.

5. The apparatus of claim 1, wherein a surface of the shutter contacted by the front edge portion of the paper has a slanted surface to guide front edge portion of the paper to the roller nip.

6. The apparatus of claim 1, wherein a spring connected to the shutter and the flag rotates the shutter and the flag in the opposite direction to return the shutter and the flag to the initial position after the paper has passed the roller nip.

7. The apparatus of claim 1, wherein a stopper controls the rotating angle of the shutter.

8. The apparatus of claim 1, wherein a centroid of the flag is located in a space in which the centroid of the shutter is located between two spaces divided by a virtual vertical plane including the rotary shaft of the shutter when the paper is not in the roller nip.

9. The apparatus of claim 1, wherein the sensor is an optical sensor.

10. An electrophotograhpic image forming apparatus, in which an image developed on an outer circumferential surface of a photosensitive medium is transferred onto a sheet of paper that is conveyed along a predetermined conveying path and the transferred image is fused onto the paper by a thermocompression method, the apparatus comprising:

a paper arranging apparatus located before the photosensitive medium on the conveying path of the paper, and arranging the paper to transfer the image onto a desired position of the paper, wherein the paper arranging apparatus includes a driving roller and an idle roller forming a nip therebetween;

a shutter connected to a rotary shaft to arrange a sheet of paper that moves along the substantially C-shaped conveying path to an upper portion by contacting a front edge portion of the paper before the front edge portion of the paper enters the nip, and the shutter rotating after being pushed by the front edge portion of the paper to not interrupt the movement of the paper;

a flag connected to the rotary shaft of the shutter to rotate in a same direction and at a same rotating angle as the shutter; and a sensor sensing position variations of the rotating flag and generating a signal representing a position of the paper being conveyed, and the rotary shaft of the shutter being positioned so that the shutter returns to an initial position by being rotated in an opposite direction by the weight of the shutter after the paper has passed through the nip of the roller, an axis of rotation of the shutter rotary shaft being spaced from axis of rotation of the driving and idle rollers.

11. The apparatus of claim 10, wherein the rotary shaft of the shutter is located in a lower space between two spaces that are divided by a virtual plane including a rotary shaft of the driving roller and a rotary shaft of the idle roller.

12. The apparatus of claim 10, wherein the rotary shaft of the shutter is located below the roller nip.

13. The apparatus of claim 10, wherein a distance from the rotary shaft of the shutter to the roller nip is longer than a radius of the roller that is relatively closer to the rotary shaft of the shutter.

14. The apparatus of claim 10, wherein a surface of the shutter contacted by the front edge portion of the paper has a slanted surface to guide the paper to the roller nip.

15. The apparatus of claim 10, wherein a spring connected to the shutter and the flag rotates the shutter and the flag in an opposite direction to return the shutter and the flag to the initial position after the paper has passed the roller nip.

16. The apparatus of claim 10, wherein a stopper controls the rotating angle of the shutter.

17. The apparatus of claim 10, wherein a centroid of the flag is located in a space where the centroid of the shutter is located between two spaces divided by a virtual vertical plane including the rotary shaft of the shutter when the paper is not in the roller nip.

18. The apparatus of claim 10, wherein the sensor is an optical sensor.

* * * * *